United States Patent [19]

Chen et al.

[11] 4,382,239

[45] May 3, 1983

[54] WAVEGUIDE COOLING SYSTEM

[76] Inventors: Alan M. Lovelace, Administrator of the National Aeronautics and Space Administration, with respect to an invention of Bill C. J. Chen; Robert W. Hartop, both of Pasadena, Calif.

[21] Appl. No.: 259,210

[22] Filed: Apr. 30, 1981

[51] Int. Cl.[3] ..... H01P 1/30

[52] U.S. Cl. ..... 333/248; 333/22 F; 333/254

[58] Field of Search ..... 333/22 F, 229, 234, 333/248, 254, 99 R

[56] References Cited

U.S. PATENT DOCUMENTS

| | | | |
|---|---|---|---|
| 2,752,572 | 6/1956 | Bird et al. | 333/22 F |
| 2,860,311 | 11/1958 | Balian | 333/248 |
| 2,947,956 | 8/1960 | Alexander et al. | 333/248 |
| 3,030,592 | 4/1962 | Lamb et al. | 333/22 F |
| 3,212,028 | 10/1965 | Wantuch | 333/248 X |
| 3,241,089 | 3/1966 | Treen | 331/11 |
| 3,369,198 | 2/1968 | Campbell et al. | 333/22 F |
| 3,599,127 | 8/1971 | Krijger | 333/256 |
| 3,600,709 | 8/1971 | Ditscheld et al. | 333/33 |
| 3,633,131 | 1/1972 | Nelson | 333/22 F |
| 3,906,402 | 9/1975 | Lesyk | 333/22 F |
| 3,940,719 | 2/1976 | Booth | 333/22 F |

*Primary Examiner*—Paul L. Gensler

*Attorney, Agent, or Firm*—Monte Mott; John R. Manning; Thomas Jones

[57] ABSTRACT

An improved system is described for cooling high power waveguides by the use of cooling ducts extending along the waveguide, which minimizes hot spots at the flanges where waveguide sections are connected together. The cooling duct (24) extends along substantially the full length of the waveguide section, and each flange (18, 20) at the end of the section has a through hole (36) with an inner end connected to the duct and an opposite end that can be aligned with a flange hole in another waveguide section. Each flange (20) is formed with a drainage groove (60) in its face, between the through hole (36) and the waveguide conduit (16) to prevent leakage of cooling fluid into the waveguide. The ducts have narrowed sections (32, 34) immediately adjacent to the flanges to provide room for the installation of fasteners closely around the waveguide channel.

7 Claims, 4 Drawing Figures

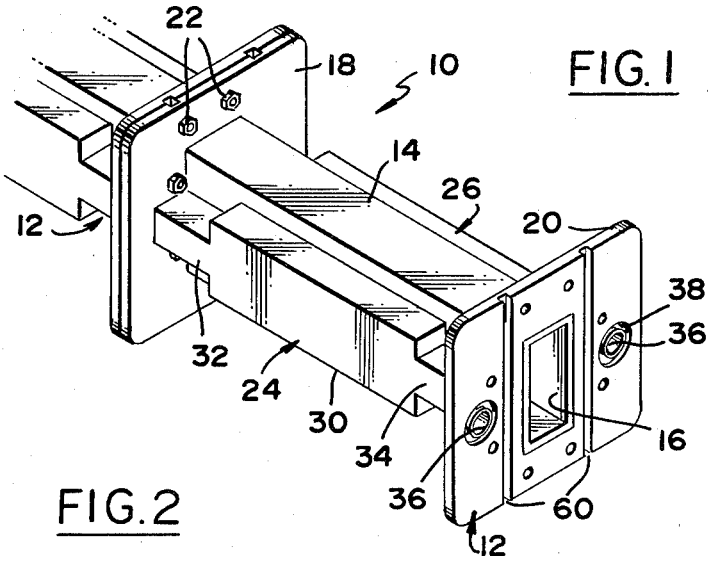
FIG. 1
FIG. 2
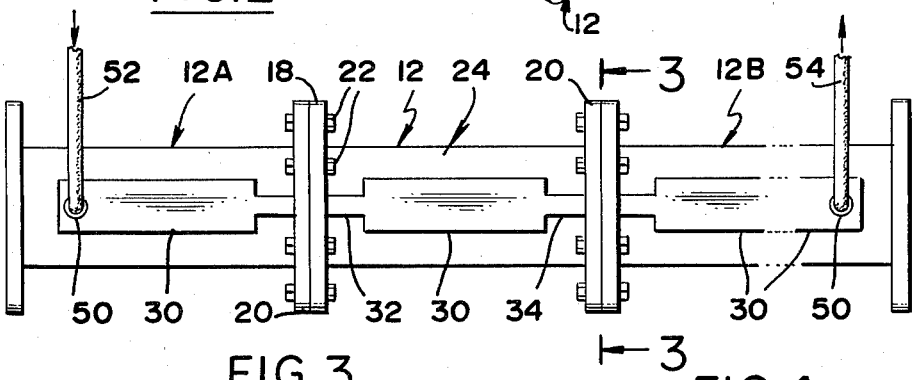
FIG. 3
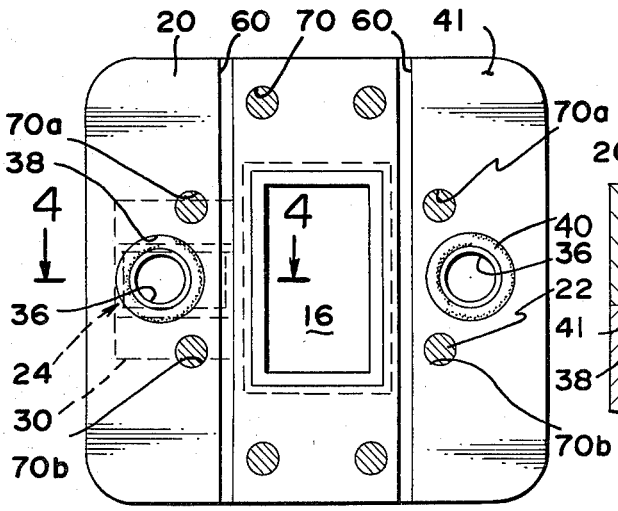
FIG. 4
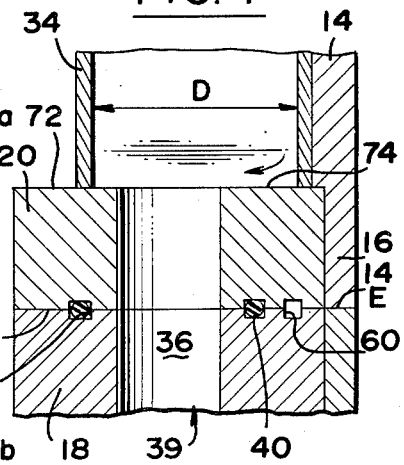

WAVEGUIDE COOLING SYSTEM

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

Waveguides are often constructed by the use of numerous waveguide sections having flanges at their ends to facilitate their connection in series. When high power microwaves are to be carried, cooling ducts can be positioned against the sides of each waveguide sections to carry a cooling fluid such as water. A duct section can be welded to either side of each waveguide section. After the waveguide sections have been connected in series the ducts can be interconnected by hoses extending around the flanges and connecting the ends of adjacent ducts. However, it has been found that power breakdown or arcing, and consequent eroding of the waveguide still occurs near the flanges of the waveguide sections. Temperature measurements have been made at various points along such waveguide sections, which show that a high temperature such as 150° C. may occur at the flanges of waveguide sections carrying microwave power at a level such as 400 kilowatts at the X-band (about 8 gigahertz). A system which minimized hot spots along a waveguide composed of numerous sections connected in series, which could be constructed at low cost, and which did not significantly interfere with rapid connection and disconnection of the waveguide sections, would be on considerable use in high power microwave applications.

SUMMARY OF THE INVENTION

In accordance with one embodiment of the present invention, a microwave waveguide is provided which minimizes hot spots along the waveguide while permitting the waveguide to be easily assembled out of waveguide sections. Each of the waveguide sections includes the usual microwave conduit with flanges at its ends and a cooling duct extending along its length direction. At least one of the flanges has a through hole that is spaced from the waveguide conduit, with one end of the hole coupled to the cooling duct and another end opening into the outer face of the flange. When flanges are connected in series with their waveguide conduits aligned, the through holes in the flanges are automatically aligned to permit the flow of cooling fluid adjacent to the flange areas of the waveguide sections so as to cool them and minimize hot spots.

Each of the flanges can be formed with a drainage groove in its outer face, with a portion of the drainage groove lying between the coolant-carrying through hole and the waveguide conduit, and with an end of the drainage groove extending to an edge of the flange. If cooling fluid leaks out of the space between the flanges of adjacent waveguide sections, any flow toward the waveguide conduit is interrupted by the drainage groove to prevent the cooling fluid from reaching the waveguide conduit. Each cooling duct can be provided with a wide portion extending beside the middle of the microwave conduit, and narrow portions near each of the flanges, to provide room for installing fasteners immediately around the waveguide conduit while providing maximum cooling of the waveguide conduit where possible.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial perspective view of a waveguide constructed in accordance with the present invention.

FIG. 2 is a partial side elevation view of the waveguide of FIG. 1.

FIG. 3 is a view taken on the line 3—3 of FIG. 2.

FIG. 4 is a sectional view taken on the line 4—4 of FIG. 3.

DESCRIPTION OF THE PREFERRED EMBODIMENT

FIG. 1 illustrates a waveguide 10 formed of individual waveguide sections 12 joined in series. Each waveguide section includes a rectangular pipe 14 forming a microwave conduit 16, and a pair of flanges 18, 20 mounted at either end of the pipe. The waveguide sections 12 are joined together at their flanges by a group of eight fasteners 22 lying closely around the rectangular pipe 14. The waveguide is designed to carry microwaves at high power levels, and is provided with cooling ducts 24, 26 at opposite sides of the rectangular pipe, to carry water or other cooling fluid.

Each of the cooling ducts such as 24 includes a wide portion 30 extending along most of the length of the waveguide section, and a pair of narrow portions 32, 34 lying near either end of the waveguide section. The narrow portions such as 34 lead directly into a through hole 36 formed in a flange, to pass the cooling fluid through the flange. As also shown in FIGS. 3 and 4, each flange is formed with a pair of holes 36 laterally spaced from either side of the waveguide conduits 16. A sealing groove 38 is formed around the through hole to hold an O-ring 40.

A pair of waveguide sections can be connected together by placing the outer faces 41 of the flanges facewise against one another, with a sealing or O-ring 40 in the grooves around the holes 36, and then fastening the flanges together with the fasteners 22. Such a connection simultaneously connects the microwave conduit 16 of the waveguide sections, and the cooling fluid passages formed by the duct 24 and flange holes 36 in each waveguide section.

As shown in FIG. 2, two of the waveguide sections 12A and 12B are modified, in that one end of each wide duct portion 30 thereof is sealed, and a hose coupling 50 is provided to connect a coolant hose 52, 54 thereto, to flow cooling fluid through the system. In the prior art, each waveguide section was provided with only the wide conduit portion 30. A hose coupling such as 50 was provided at either end of each conduit portion such as 30 of a waveguide section. Short hoses were utilized to interconnect the conduit portions such as 30 of adjacent waveguide sections, with each short hose extending around the joined flanges of the waveguide sections. This not only required many more parts and steps in the joining of waveguide sections, but also resulted in hot spots near the flanges, to which the cooling ducts did not directly extend. It was thought that by separating the cooling connections from the waveguide conduit connections, greater reliability could be achieved in each connection. However, the high temperatures at the ends of the waveguide sections leads to cold plasma arcing and consequent erosion of the waveguides, which has limited the power levels that could be transmitted through the waveguides.

In the present waveguide, the mechanical connection of the microwave conduits 16 and of the cooling passages at the holes 36, are made at the same time when the flanges of a pair of waveguide sections are joined, and yet these two conduits or passages are maintained reliably separate from one another. The flange faces 41 are ground flat and engage one another facewise, so there is substantially no gap at the faces 14E of the rectangular pipes 14 that form the waveguide. The sealing of the coolant passage 39 is made by way of the elastomeric sealing rings 40 which do not interfere with face-to-face contact of the flanges. In order to avoid damage to the waveguide pipe 14 if an O-ring 40 fails, so that water under pressure might be forced into the waveguide conduit, a drainage groove 60 is formed in each flange. Each drainage groove 60 extends between the end of the waveguide conduit 16 and the hole 36 in the flange, so that if any cooling fluid should leak out of the cooling fluid passage towards the waveguide 16, it would first have to enter the groove 16. The groove 16 also extends to the extreme edge of the flange, so any cooling fluid will be drained into the environment to avoid the buildup of fluid pressure in the groove. Each groove can be formed by merely milling a straight groove across the width of the flange face, to lie between the waveguide conduit 16 and the flange hole 36.

The narrower cooling duct portions such as 34 which extend up to the flanges such as 20, are utilized to provide room for the installation of fasteners 22 close to the waveguide conduit 16 so as to securely join the flanges without any significant gap between the waveguide pipe ends 14E. It may be noted that each duct portion could be formed of a C-section together with a side of the waveguide pipe, although this would result in considerably more welding and the greater possibility of leakage out of a failed weld. As shown in FIG. 3, the flange 20 has eight fastener holes 70, of which two **70*a*, 70*b* on either side of the waveguide conduit lie close to the narrow conduit portion 34. However, the narrow conduit portion 34 is still wider than the hole 36 so that all of the conduit portion 34 can be positioned in alignment with the hole 36**.

Cooling of the end portion of the waveguide pipe 14 is enhanced by several factors. In addition to the cooling resulting from cooling fluid such as water flowing through the hole 36 (FIG. 4), cooling of the end portion of the waveguide section is enhanced by the water flowing directly along the inside face 72 of the flange, at the flange face region 74 lying between the waveguide conduit 16 and the through hole 36. This results from constructing the narrower duct portion 34 with considerable depth D to extend from close to the pipe 14 to a position across the flange hole 36. Of course, there is also cooling along the length of the narrow conduit portion 34 where it is against the waveguide pipe 14.

A waveguide 10 of the type described herein has been constructed and tested at power levels of up to 600 kilowatts, at X-band (near 8 gigahertz), the power level being limited by the microwave source rather than the waveguide power-carrying capacity. Prior art waveguides of the same construction, but with coolant ducts extending only partially along each section and connected together by hoses, could be utilized at power levels of only 330 kilowatts before serious cold plasma arcing occurred. At the same power levels, the maximum temperature along the walls of the waveguide conduits 16, which occur at the ends of the waveguide sections, were found to be reduced from 105° C. to 35° C.

Thus, the invention provides a cooled high power microwave waveguide, which reduces hot spots along the waveguide that can limit its power carrying capacity, while also facilitating the connection of waveguide sections to set up to waveguide. This can be accomplished by utilizing a through hole in the flanges of the waveguide sections at locations spaced from the waveguide conduit and extending the cooling ducts up to the flanges, so that cooling fluid flows up to and through the flange portions of the waveguide sections. Leakage of cooling fluid where the flanges of adjacent waveguide sections are joined, can be avoided by utilizing an O-ring in a groove around the hole, and by providing a drainage groove in the flange face, with a portion of the drainage groove lying directly between the coolant-carrying hole and the waveguide, and with another portion of the drainage groove extending to the extreme edge of the flange to drain fluid into the environment. The cooling duct along each waveguide section, can include a wide portion extending along most of the length of the waveguide section, and a narrower portion immediately adjacent to each flange to avoid interference with the installation of fasteners that join the flanges of different waveguide sections together, but with the narrow duct portion deep enough to flow cooling fluid along the inside face of the flange.

Although particular embodiments of the invention have been described and illustrated herein, it is recognized that modifications and variations may readily occur to those skilled in the art and consequently, it is intended that the claims be interpreted to cover such modifications and equivalents.

We claim:

1. A microwave waveguide, comprising:

a waveguide section which includes a conduit pipe forming a microwave conduit and having a pair of pipe ends, a flange mounted at either end of the pipe, and walls forming a cooling duct extending along the length direction of said conduit and lying beside said conduit pipe;

at least one of said flanges having a through hole therein laterally spaced from said conduit and having one hole end coupled to said cooling duct.

2. The waveguide described in claim 1 wherein:

said one flange has a drainage groove formed on the flange face which is opposite said duct, said groove lying between said hole and said microwave conduit, and said groove extending to an edge of the flange, whereby to drain away cooling fluid so it does not reach said waveguide conduit.

3. The waveguide described in claim 1 wherein:

said one flange has a plurality of fastener holes spaced about said conduit pipe for receiving fasteners to attach to a flange of another waveguide section; and said duct has a wide portion extending beside the middle of the conduit pipe, and a narrower portion adjacent to said flange, whereby to provide room for installing fasteners and to also provide maximum cooling of the end of the conduit pipe.

4. The waveguide described in claim 1 wherein:

said cooling duct has an end portion of greater depth than said through hole, said duct end portion extending up to said flange, to flow cooling fluid along a flange portion lying between said through hole and said microwave conduit.

5. A microwave waveguide, comprising:

a plurality of waveguide sections, each section having walls forming a microwave conduit, a flange at each end of each of said conduits, and a cooling duct extending along the length direction of each conduit up to either flange;

each flange having a pair of holes, said holes lying at and spaced from either side of said microwave conduit, and each hole having an inner hole end in communication with one of said cooling conduits and an outer hole end at the outer face of the flange which lies opposite the cooling duct of the same waveguide section;

said waveguide sections joined in series, with the conduits and flange holes of adjacent waveguide sections in alignment, and with at least one flange of each adjacent pair of flanges forming a groove around a flange hole, and including an O-ring in the groove.

6. The waveguide described in claim 5 wherein:

at least one flange of each adjacent pair of flanges forms a drainage groove lying between the aligned holes of the flanges and the aligned ends of the microwave conduits.

7. The waveguide described in claim 5 wherein:

an end of each duct which extends up to a flange has sufficient depth to flow cooling fluid along a portion of a face of the flange which lies between the microwave conduit and said flange hole.

* * * * *